US005647727A

United States Patent [19]

Taniguchi et al.

[11] Patent Number: 5,647,727

[45] Date of Patent: Jul. 15, 1997

[54] IMAGE FORMING APPARATUS WITH FAN COOLING

[75] Inventors: Akihiko Taniguchi, Yamatokouriyama; Masashi Toyoda, Nara, both of Japan

[73] Assignee: Sharp Kabushiki Kaisha, Osaka, Japan

[21] Appl. No.: 439,376

[22] Filed: May 11, 1995

[30] Foreign Application Priority Data

Jun. 22, 1994 [JP] Japan ..... 6-140105

[51] Int. Cl.[6] ..... F04B 49/10

[52] U.S. Cl. ..... 417/32; 417/1; 355/30; 399/92

[58] Field of Search ..... 417/32, 1, 44.1; 355/30, 202

[56] References Cited

U.S. PATENT DOCUMENTS

| | | | |
|---|---|---|---|
| 4,903,072 | 2/1990 | Iwata | 355/30 |
| 5,095,333 | 3/1992 | Shimada . | |
| 5,144,366 | 9/1992 | Sakamoto et al. . | |
| 5,150,154 | 9/1992 | Kuwabara | 355/208 |
| 5,151,573 | 9/1992 | Masuda | 219/216 |
| 5,172,159 | 12/1992 | Nakagama et al. | 355/30 |
| 5,508,782 | 4/1996 | Koh et al. | 355/30 |

FOREIGN PATENT DOCUMENTS

| | | |
|---|---|---|
| 4201498 | 7/1992 | Germany . |
| 61-219966 | 9/1986 | Japan . |
| 1-209458 | 8/1989 | Japan . |
| 1-214836 | 8/1989 | Japan . |
| 2-103060 | 4/1990 | Japan . |
| 2-214871 | 8/1990 | Japan . |
| 3-144627 | 6/1991 | Japan . |
| 4-23339 | 8/1992 | Japan . |
| 4-372941 | 12/1992 | Japan . |
| 6-91986 | 4/1994 | Japan . |

OTHER PUBLICATIONS

Patent Abstracts of Japan, vol. 14, No. 317 (P1073) Jul. 9, 1990 & JP–A–02 103 060 (Konica) *abstract*.

*Primary Examiner*—Michael Koczo
*Assistant Examiner*—Xuan M. Thai

[57] ABSTRACT

In an image forming apparatus provided with a cooling fan for cooling an original table glass, a controller measures a cooling time from the end of a previous copying operation to the start of a current copying operation. An operating condition determining section estimates a residual amount of heat energy based on the measured time and the generated amount of heat energy at the pervious copying operation. An amount of heat energy to be generated at the current image forming is added to the thus estimated residual amount of heat energy. Based on the sum of the heat energy, actual temperature-rise characteristics are calculated. The fan is driven at a rotating rate for an operating time in accordance with the thus calculated temperature-rise characteristics.

8 Claims, 9 Drawing Sheets

IMAGE FORMING APPARATUS WITH FAN COOLING

BACKGROUND OF THE INVENTION (1) Field of the Invention

The present invention relates to an image forming apparatus such as an electrostatic photocopier, a printer and the like and more particularly relates to an image forming apparatus equipped with a fan for inhibiting temperature rise inside the apparatus.

(2) Description of the Prior Art

Conventional copiers use a halogen lamp as a light source for an exposure device which illuminates an original at the time of copying. This is because the halogen lamp is highly efficient as compared to a typical incandescent lamp.

The halogen lamp, however, gives out a great amount of heat, therefore if a prolonged period of use such as consecutive copying operations are made, the surface of the original table glass near the exposure device is heated to a great extent. In order to prevent a user from being burned when the user touches the original table glass, some domestic and foreign safety standards have been established which limit the surface temperature of the original table glass to a regulated level or less. To meet the standards, a cooling fan is provided for a copier of this kind to cool by force the original table glass as well as the vicinity of the exposure device. As to the inside of the copying machine, heat from the heater for the fixing unit as well as heat from the exposure device and other devices elevates the temperature inside the machine. Further, ozone gas etc., generated from the charging device affects the photoreceptor drum, the developing unit and the like to thereby degrade the quality of copy. To prevent this, a ventilating fan is provided in order to lower the inside temperature of the machine and to exhaust air inside the machine.

These fans are driven in response to signals from a controller provided in the copier. That is, when the user inputs a number for copies through a control section 1 and activates the copying operation, a micro-computer 3 in a controller 2 outputs three levels of signals to a fan controlling circuit 4 in accordance with the designated number of copies, as shown in FIG. 1. More specifically, the rotating rate of a fan 5 is varied during the copying operation so that the cooling operation may be effected by three levels, that is, strong blow, middle blow and weak blow in association with the designated number of copies. When the copier is disengaged, such blow cooling is not needed, so that the fan 5 is reduced in its rotating rate or stopped in order to decrease noises therefrom and save the energy. In the disengaged mode, if, even with only the fan 5 stopped, temperature control of the heater in the fixing unit is done as usual, the power consumption is hardly reduced, therefore little energy can be saved. Since such a configuration has little effect on saving energy and it is impossible for the system to lower the temperature inside the machine, the temperature of the heater in the fixing unit should also be lowered during the disengaged mode as compared to the usual temperature at which fixing is allowed. Actually, this was done in the conventional configuration. Meanwhile, the configuration in FIG. 1 includes a main switch 5, an a.c. power supply 7, a power source circuit 8, a machine controlling circuit 9 for controlling various parts of the copier in response to output signals from a micro computer.

Several methods which use fan control of this kind, that is, the control based on the designated number of copies, have been proposed in, for example, Japanese Patent Application Laid-Open publications Sho 61 No.219,966, Hei 1 No.209,458, Hei 1 No.214,836 and Hei 2 No.103,060. Specifically, these publications disclose copiers in which temperature rise inside the machine is prevented and noises are reduced by switching a fan for cooling an exposure lamp between strong and weak intensity modes by turning on and off a fan and by varying the operating time of a fan with reference to the designated number of copies at copying.

Nevertheless, since the characteristics of temperature rise of the original table glass and the machine-inside of the copier vary depending upon not only the number of copies, but also upon specific copying operations such as the sheet size, magnification, copying density and the like, the aforementioned methods, that is, the switching of blow intensity of the fan, the on-and-off switching of the fan, the switching of operating time of the fan in accordance with the designated number of copies are not enough to regulate actual temperature rise or variation of the original table glass and the machine-inside of a copier and therefore the copier still suffers from insufficiency of cooling or excessive cooling. Particularly, if the copier-inside is excessively cooled, the heater temperature in the fixing unit should become high, therefore power consumption becomes large due to the heat loss, and consequently, efficient operation of the copier and comfortable setting environment are deteriorated. Besides, in the copier in which the fan is turned on and off, a supplied blowing amount of air is determined by the specifications of the fan used, therefore, the noise characteristics and the maximum air-blowing amount (required air-blowing amount) are also determined just by the capacity proper to the fan used (without any maximum limit). In other words, in this conventional configuration, no efficiency of the fan was taken into account for cooling and lowering noises.

To solve the above problems, Japanese Patent Application Laid-Open publications Hei 3 No.144,627, Hei 4 No.238,339 and Hei 4 No.372,941 disclose copiers and the like in which the air-blowing amount of a fan for cooling an exposure lamp is switched between strong and weak intensity modes or among strong, medium and weak intensity mode with reference to designated copying specifications such as the number of copies, recording sheet size, magnification, exposure lamp intensity, scan length etc. In one word, these disclosures intend to control the operation of fan by assuming the temperature rise according to designated copying specifications and regulating the operation of the fan based on the assumption.

Since, even such copiers, the adjustment of air-blowing amount of the fan is merely made between two modes (strong and weak intensity modes) or three modes (strong, medium and weak modes), the conventional cooling control system is not enough efficient to suffice the recent demands such as of energy saving as well as of restricting the generation of ozone gas which has adverse influence on the human body.

Further, although the conventional system assumes a temperature rise based on the copying specifications, this assumption is made for only a future copying operation without taking the past use of the machine into consideration. Therefore, if, for example, a second copying operation is effected before the heat of the original table glass and the machine-inside due to a first copying operation is enough cooled down, the temperature of the original table glass and the machine-inside is elevated from a high-temperature state to a still higher-temperature state. Accordingly, the actual temperature differs from the temperature expected based on the second copying specifications and consequently, insufficiency of cooling occurs. That is, when two copying operations were made with a small interval, the conventional configuration could neither cool down the machine properly nor efficiently while it was impossible to realize reduced noises and saved energy.

SUMMARY OF THE INVENTION

It is therefore an object of the present invention to provide an image forming apparatus capable of surely inhibiting temperature rise inside the machine by determining actual temperature rise based on usage history or usage conditions of the apparatus and a cooling time of the apparatus. in accordance with temperature-rise characteristics of the machine-inside which is calculated based on the sum of heat energy.

In accordance with a third feature of the present invention, an image forming apparatus comprises: a cooling fan for inhibiting the temperature rise inside the machine body; and a controller for controlling the operation of the fan, and is constructed such that the controller includes an operating condition determining means for determining operating conditions of the fan based on usage history of the apparatus.

In a problem solving means in accordance with the above first or second feature, when a previous image forming operation is complete, a cooling time to a next image forming operation is started to measure. When the next image forming operation starts, the measurement of the cooling time is ended. Based on the measured time, the system estimates a dissipated energy amount from the previous heated state at the pervious image forming so as to determine a residual amount of heat energy by subtracting the dropped amount of heat energy from the amount of energy generated at the pervious image forming. An amount heat energy to be generated at the current image forming is added to the thus estimated residual amount of heat energy. Based on the sum of the heat energy, actual temperature-rise The present invention has been achieved to attain the above object, and in accordance with a first feature of the present invention, an image forming apparatus comprises: a cooling fan for inhibiting the temperature rise inside the machine body; and a controller for controlling the operation of the fan, and is constructed such that the controller includes an operating condition determining means for determining operating conditions of the fan based on an amount of heat energy generated in a previous image forming operation, a dropped amount of heat energy from the end of the previous image forming operation to the start of a current image forming operation and an amount of heat energy generated in the current image forming operation.

A second feature of the present invention resides in an image forming apparatus according to the above first feature and is constructed such that the operating condition determining means measures a cooling time from the end of a previous image forming operation to the start of a current image forming operation, estimates a residual amount of heat energy at the start of the current image forming operation based on an amount of heat energy generated in the previous image forming operation and the measured cooling time, adds up an amount of heat energy generated in the current image forming operation and the residual amount of heat energy and determines a rotating rate and an operating time of the fan characteristics inside the machine are calculated. The fan is driven at a rotating rate for an operating time in accordance with the thus calculated temperature-rise characteristics. As a result, the machine-inside is cooled down properly and efficiently.

In a problem solving means in accordance with the above third feature, when an image forming operation is complete, the system statistically processes the usage history, that is, what kinds of operations have been done, the frequency of usage and the volume of image forming operations and the like, so as to determine the usage history per a unit period of time. Based on the thus determined usage history per a unit period, temperature-rise characteristics are calculated. The fan is driven at a rotating rate for an operating time in accordance with temperature-rise characteristics.

DESCRIPTION OF THE PREFERRED EMBODIMENTS

First Embodiment

Figure 2:
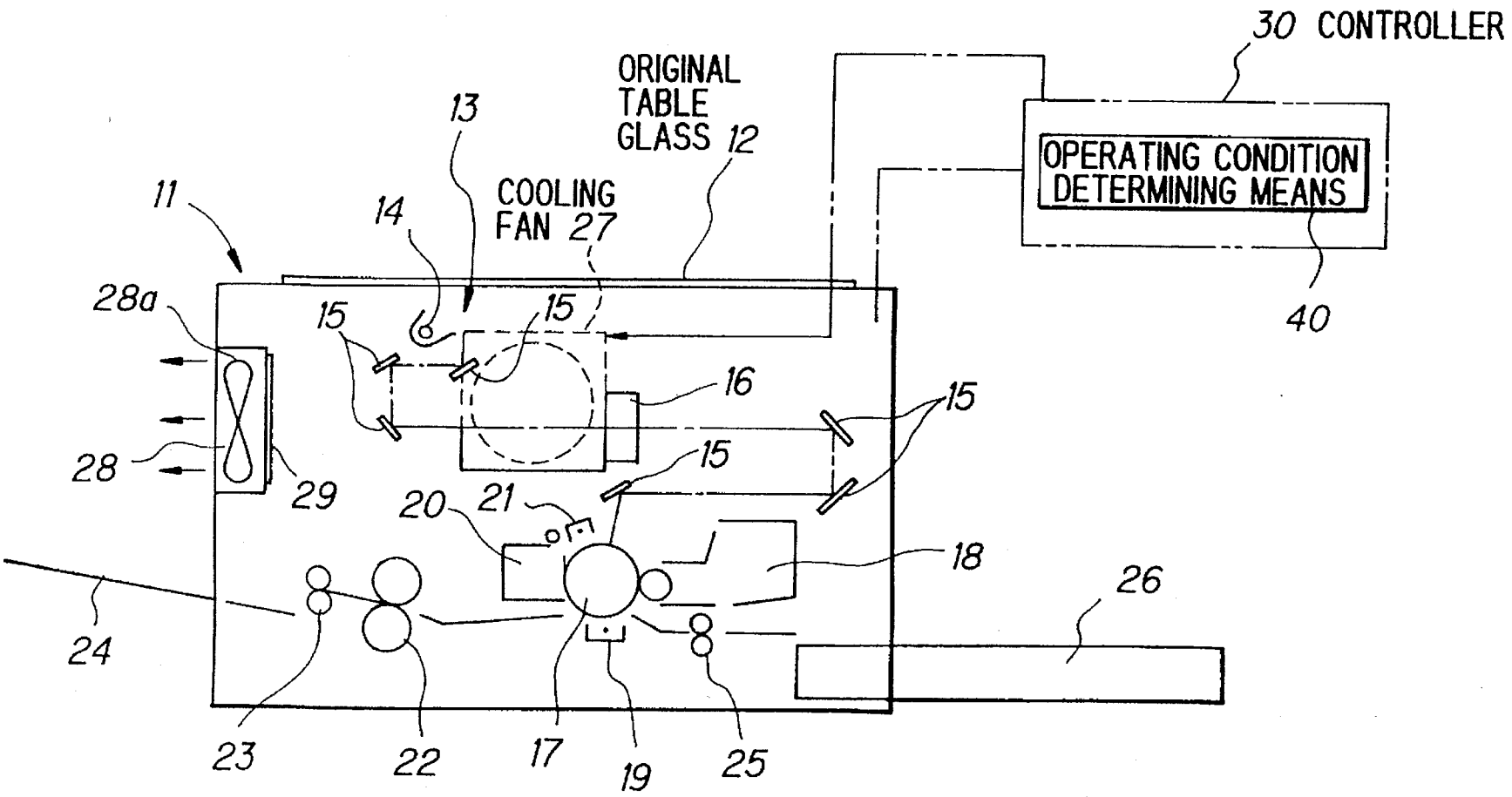
FIG. 2 is a structural view showing an image forming apparatus of a first embodiment of the present invention.
Figure 3:
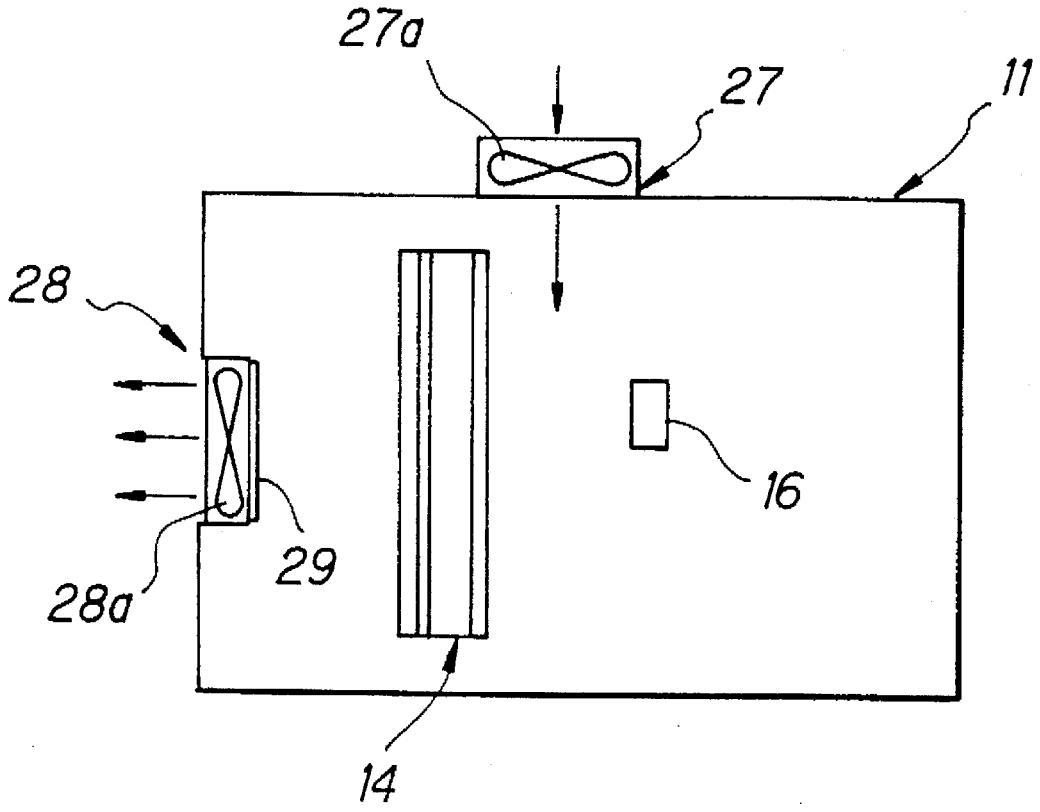
FIG. 3 is a view showing an arrangement of cooling devices in the image forming apparatus shown in FIG. 2.

FIGS. 2 and 3 show an overall configuration of a copier in accordance with an embodiment of the present invention. In FIGS. 2 and 3, a copier body 11 includes: an original table glass 12 made of a glass plate arranged on the top of the copier body 11; an exposure device 13 equipped with a halogen lamp 14; reflecting mirrors 15; a lens 16; a photoreceptor 17; a developing unit 18; a transfer charger 19; a cleaning unit 20; a charger 21; a fixing unit 22; sheet discharging rollers 23; a sheet output tray 24; registration rollers 25; a paper feeding cassette 26; a cooling fan 27 for cooling the original table glass 11 and the vicinity of the exposure device 13; and a ventilating fan 28. Here, the copier structure is well known so that detailed explanation thereof is omitted.

The cooling fan 27 is made of a brush motor driven by an a.c. power supply and a propeller-like fan 27*a* attached to the motor shaft and disposed in a middle lower portion on the backside of the copier body. This cooling fan 27 activates in response to a signal from a controller detailed later when the machine-inside and the original table glass 12 are elevated in temperature due to heat generated from the halogen lamp 14 in the exposure device 13 during copying operations so that the surface of the original table glass 12 may be kept at a temperature of lower than a regulating temperature specified by both the domestic and foreign safety standards.

The ventilating fan 28 is similarly made of a brush motor and a propeller-like fan 28*a* and attached to a side wall of the copier body in an upper part of the sheet output tray 24. The ventilating fan 28 rotates all the time to ventilate the air inside the machine. An ozone filter 29 is provided in a sucking port on the side of the machine-inside in order to eliminate ozone gas generated from the charger 21. That is, the air inside the machine is discharged outside through the ozone filter 29.

Provided on the top of the copier body 11 is a control panel including: a key input portion having a copy start button and other input keys for setting the number of copies, a magnification ratio, copy density, a original size, a sheet size etc.; and a display portion for displaying copying specifications, status of the copier etc., with pictures, characters etc.

Figure 4:
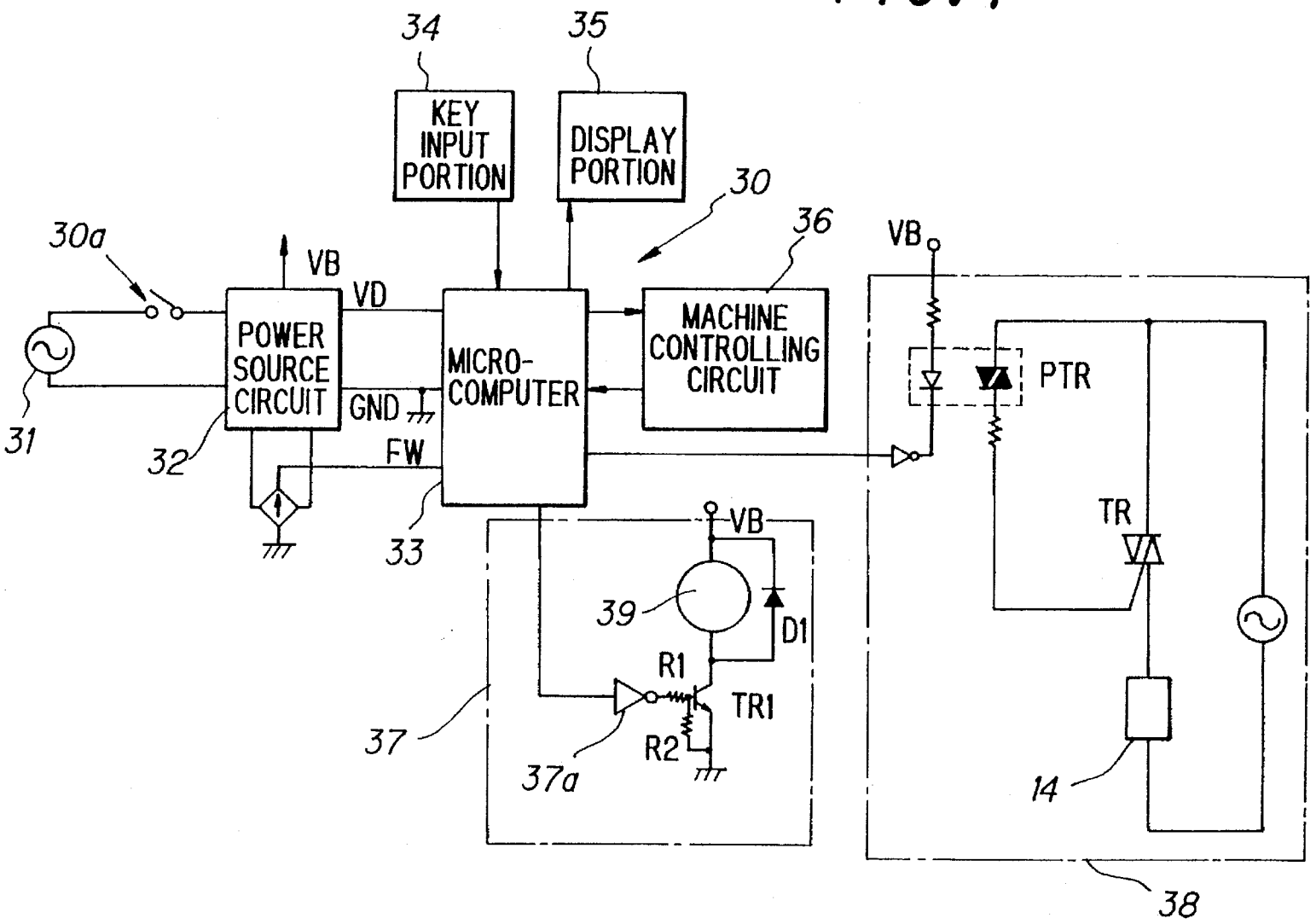
FIG. 4 is a block diagram showing a controller shown in FIG. 2.

Provided for the copier is a controlling unit 30 which synthetically controls driving operations of the fans 27 and 28 and other portions as well as copying operations based on the copying specifications set up through the buttons and keys etc., on the control panel. The controlling unit 30 is supplied from an outside a.c. power supply 31 as shown in FIG. 4 and comprises: a power source circuit 32 producing a control-system power source voltage VD and a load controlling voltage VB from the a.c. power supply 31 to output them to various portions; a micro computer 33 operated by the control-system power source voltage VD from the power source circuit 32; a key input portion 34 and a displaying portion 35 provided on the control panel; a machine controlling circuit 36 for controlling various parts of the machine by output signals from the microcomputer 33; a fan controlling circuit 37 for controlling the cooling fan 27 by an output signal from the microcomputer 33; and a lamp controlling circuit 38 for controlling a halogen lamp 14 of the exposure device 13 by an output signal from the microcomputer 33. Here, designated at 30*a* in FIG. 4 is a main switch for the copier.

The microcomputer 33 includes a CPU, a ROM, a RAM, a timer for measuring the copying time and operation time of various parts and synchronizing operation timings of various components. The power source circuit 32, the machine controlling circuit 36 and key input portion 34 are connected on the input side of the microcomputer Connected on the output side of the microcomputer 33 are the display portion 35, the machine controlling circuit 36, the fan controlling circuit 37 and the lamp controlling circuit 38.

The fan controlling circuit 37 receives a PWM (pulse width modulation) signal from the microcomputer 33 which regulates the power source voltage to be applied to the brush motor 39 so as to control the rotating rate of the brush motor 39. The fan controlling circuit 37 has an NPN transistor TR1, resistors R1 and R2, a NOT circuit 37*a*. The transistor TR1 is connected at a collector terminal thereof with one of terminals of the brush motor 39, and connected at a base terminal thereof with the output side of the microcomputer 33 through the resistor R1 and the NOT circuit 37*a*. The emitter terminal of the transistor TR1 is grounded while the resistor R2 is connected between the emitter and base. The other terminal of the brush motor 39 is impressed with the load controlling voltage VB from the power source circuit 32. A diode D1 is connected in parallel with the brush motor 39. As the PWM control of the brush motor 39 is publicly known, the detailed description of this technology is omitted.

Here, the copying specifications (the number of copies, magnification, copy density, original size, paper size etc.) designated through the key input portion 34 are all inputted to the microcomputer 33, therefore the microcomputer 33 is able to determine, based on the copying specifications, how much heat will be generated from the halogen lamp 14 of the exposure device 13 at the copying operation in question. That is, at the time of a copying operation, the surface temperature of the original table glass 12 varies depending upon the copying specifications, the rotating rate of the cooling fan 27 as well as the operating time must be changed in accordance with the copying specifications for each coping operation.

Figure 5:
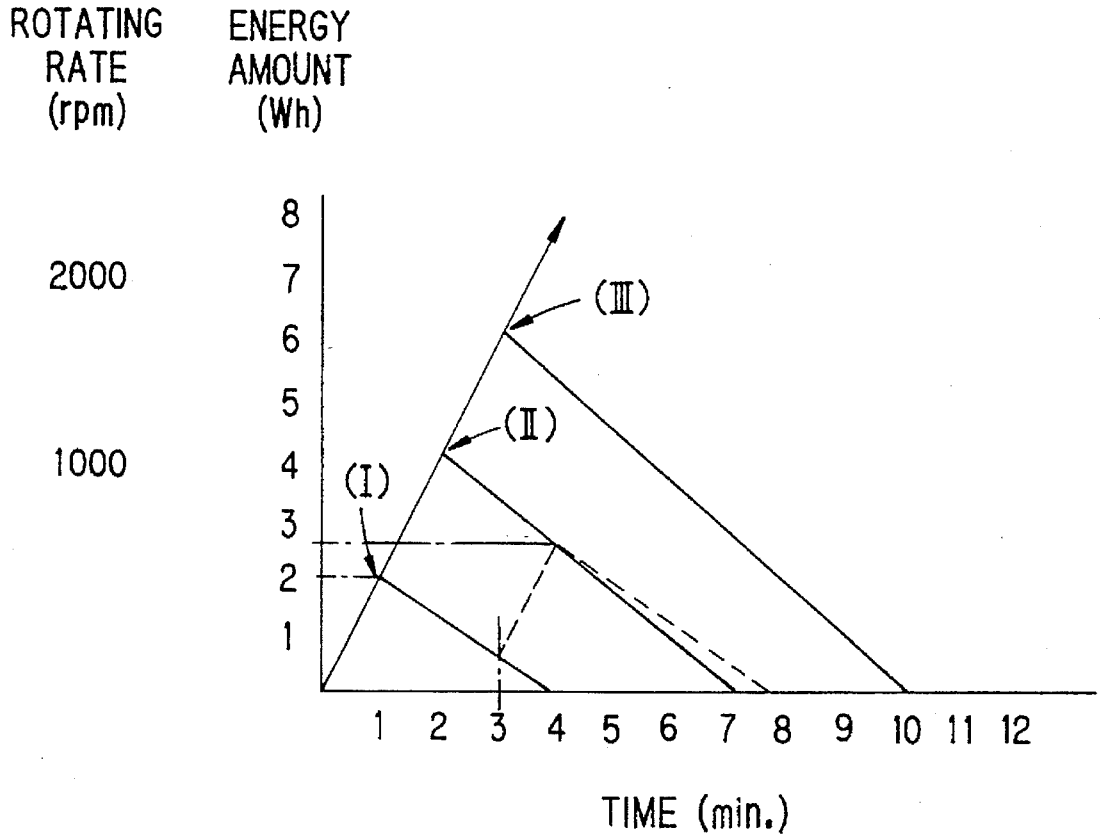
FIG. 5 is a chart showing characteristics of temperature variations in accordance with copying specifications.

For example, if two copies of an original having a size of A4 is reproduced on a sheet of paper of A4 at the identical magnification with normal copy density, the halogen lamp 14 will not be used in its full power condition (200 W) but is made to emit light with an output of 160 W. From this, the heat-generated amount (heat energy amount) can be known and the microcomputer can estimate how many degrees the surface temperature of the original table glass 12 increases within how long time and how many degrees the surface temperature of the original table glass 12 lowers within how long time after the end of the copying operation. By this estimation, the microcomputer deduces varying temperature characteristics as shown in FIG. 5 for different copying specifications. FIG. 5 shows varying temperature characteristics when consecutive 10 copies (I), 20 copies (II) and 30 copies (iii) are produced at typical copying specifications in which an A4 original is copied on an A4 sheet at the identical magnification with normal copy density. More specifically, a case of the consecutive ten copying operations (I), for instance, takes one minute from the copy start to the copy end, generating the heat energy amount of 2 Wh and requires four minutes for cooling down after the copy end. Usually, these characteristics are replaced by the following approximate expressions for calculations:

$$\text{temperature-rise formula: } Yu=2\times X \quad (1)$$

$$\text{temperature-drop formula: } Yd=(2/3)\times X \quad (2)$$

where X designates a time (min.) from the start to the end of the copying operation or a lapse (min.) after the end of the copying operation. the copying operation. Here, the inclination of temperature-rise characteristics varies depending upon copying specifications. Specifically, the inclination varies depending upon the brightness of the halogen lamp 14. That is, the slope becomes steep when it is bright and becomes easy when it is dim.

Stored in the microcomputer 33 is experimental data which has, in advance, been determined in association with the temperature-rise characteristics based on the performances of the brush motor 39, as to optimum relations between rotating rates and operating time (time from the copy start to the copy end and time from the copy end until the surface temperature of the original table glass 12 becomes lower than the regulating threshold) of the cooling fan 27 for cooling down. The microcomputer 33 controls the action of the cooling fan 27 using the data in association with temperature-rise characteristics determined by the copying specifications. Specifically, the system is so set up that the fan may activate at a low rotating rate for a short span when copies are to be made less frequently (or heat energy emitted is low) while the fan may activate at a higher rotating rate for a longer span as the number or frequency of copies becomes great (or heat energy generated increases).

However, if before the original table glass 12 is enough cooled down after a first copying operation, a second copying operation is made in the same copying specifications as in the first operation, the original table glass 12 which is already high in temperature is further heated to a higher degree. Therefore, the temperature-characteristics calculated based the second copying specifications differ from the actual temperature-characteristics. Consequently, an equivalent operation of the cooling fan 27 to the previous operation, can not cool the system sufficiently. Specifically, as shown in (I) in FIG. 5, when the heat energy amount at the copy end of the first operation is 2 Wh, a decline of the heat energy amount two minutes after the copy end can be calculated from the formula (2) as:

$$Yd=(2/3)\times 2=4/3\ (Wh) \quad (3)$$

From this calculation (3), the residual amount of heat energy can be calculated as $2-(4/3)\approx 0.5$ Wh.

In this situation, if a second copying operation of the same copying specifications is made, the heat energy amount at the copy end of the second copying operation becomes as shown with a broken line in FIG. 5 and the heat energy amount emitted in the second operation is determined from the formula (1) as:

$$Yu=2\times 1=2\ (Wh) \quad (4)$$

The residual amount of heat energy 0.5 Wh is added to result in 0.5+2=2.5 (Wh). That is, the actual amount of heat energy becomes greater than the estimated amount of heat energy based on the copying specifications.

To deal with the situation described above, the copier of this embodiment, an operating condition determining means 40 is provided for the microcomputer 33 in the controller 30 for the purpose of determining the operating condition of the cooling fan 27 based on the heat energy amount at the pervious copying operation, the cooling time from the end of the last copying operation to the start of the current copying operation and the heat energy amount to be generated at the current copying operation.

The operating condition determining means 40 measures the cooling time from the end of the last copying operation to the start of the current copying operation and determines the residual amount of heat energy from the heat energy amount generated at the last copying operation and the measured time. Then, the means 40 adds up the heat energy amount to be generated at the current copying operation and the residual amount of heat energy and estimates temperature-rise characteristics based on the total heat energy amount to determine the rotating rate and the operating time of the cooling fan 27, whereby the cooling fan 27 is driven in the thus determined condition.

Figure 6:
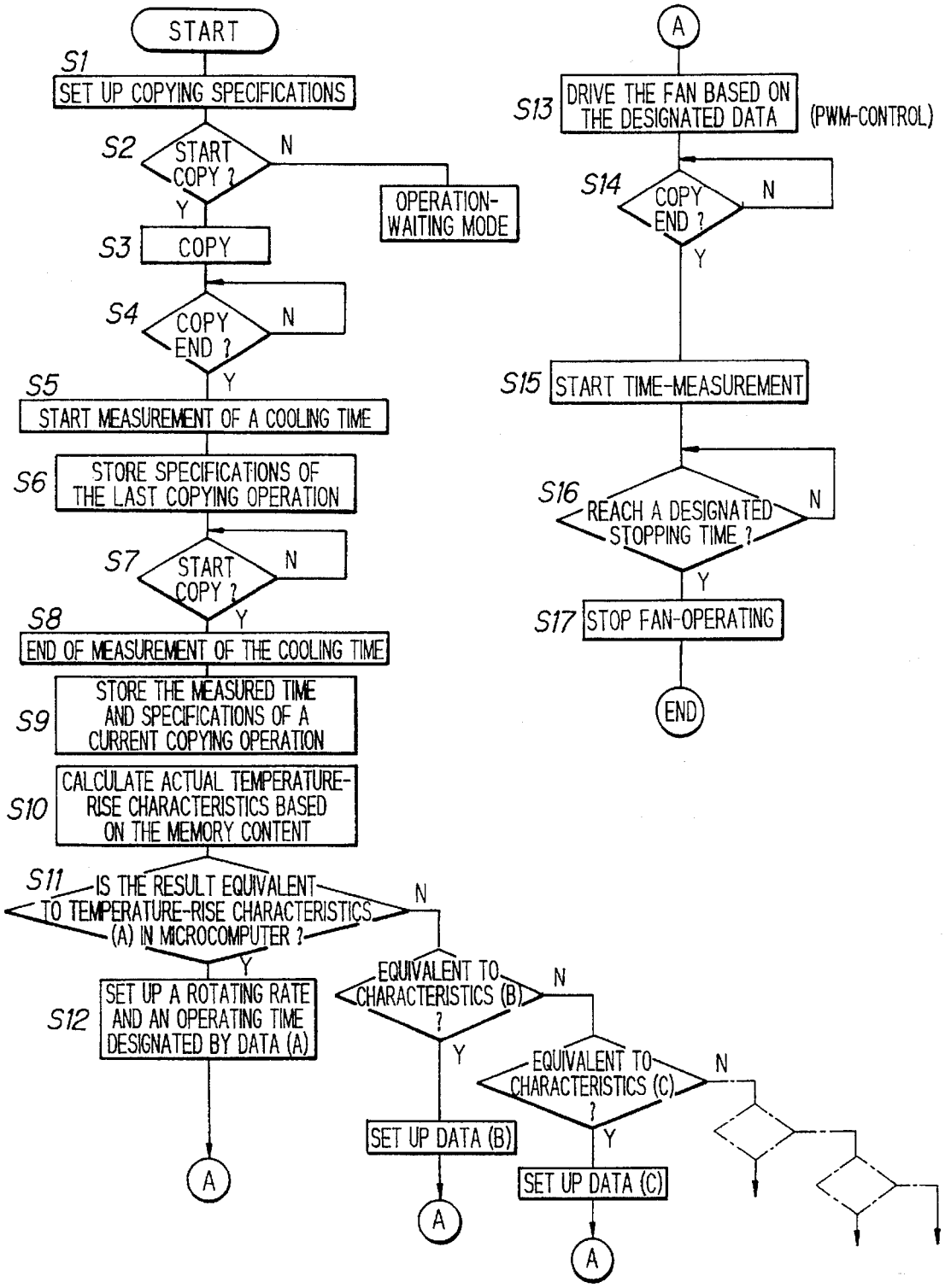
FIG. 6 is a flowchart showing a cooling control system in a first embodiment of the present invention.

In the configuration described above, the copying operation of the copier will be described with reference to a flowchart shown in FIG. 6. First of all, the main switch 30*a* is turned on, then the a.c. power supply 31 is applied to the power source circuit 32, which in turn produces the control-system power source voltage VD and the load controlling voltage VB to supply various components. With this activation, the heater in the fixing unit 22 is heated up to a state which allows copying operations. When the machine becomes ready to effect copying operations, a user sets up copying specifications through the control panel and pushes the start button (S1). Then, a copying operation starts in accordance with the set up copying specifications (S2 and S3). Here, if the copying operation is effected immediately after the main switch 30*a* is turned on, the surface temperature of the original table glass 12 is not so high that the cooling fan 27 is not activated. However, if, depending upon copying specifications, a large quantity of heat energy will be generated as in a case where many copies are to be made, the cooling fan 27 may be set up to be driven at a rotating rate capable of handling the temperature-rise characteristics for such cases.

When the copying operation finishes (S4), the timer is activated to measure the cooling time up to a next copying operation (S5) and the last copying specifications are stored in the microcomputer 33 (S6).

As next copying specifications are set up and the start button is pressed (S7), the measurement of the cooling time is stopped (S8) and the measured time and the current copying specifications are stored in the microcomputer 33 (S9). At that time, if the time span from the end of the last copying operation to the start of the current copying operation is short, the original table glass 12 and the machine-inside have not been enough cooled. Therefore, a residual amount of heat energy is determined based on the heat energy amount estimated for the previous copying operation and the measured time. This residual amount of heat energy is added to a heat energy amount estimated for the current copying operation based on the current copying specifications. The thus summed heat energy amount is used to deduce the actual temperature-rise characteristics (S10). Then, data as to a rotating rate and operating time of the fan in association with the thus calculated temperature-rise characteristics is extracted from the microcomputer 33 (S11 and S12). Based on the data, the microcomputer 33 sends out a PWM signal to the fan controlling circuit 37, so that the cooling fan 27 is driven at a higher rotating rate for a longer operating time (S13) than those to be set up just for the current copying specifications, to thereby cool down the vicinity of the exposure device 13 and the original table glass 12.

After the copying operation is complete (S14), counting of the cooling time until a next copying operation is started (S15) while the cooling fan 27 continues to rotate at the same rotating rate as in the copying operation. When it comes to the time designated by the data to stop the fan (or the time the original table glass 12 is cooled down to the regulating temperature or less) (S16), the copier stops the rotation of the fan (S17) and enters the preheating or waiting node for copy-allowable state. Thus, the above-described operations will be repeated.

In this way, the operating condition of the cooling fan 27 is determined based on the heat energy amount at the previous and current copying operations as well as the cooling time from the end of the previous copying operation to the start of the current copying operation, so that, if a second copying operation is started before the rise of the surface temperature of the original table glass 12 due to a first copying operation is enough cooled down, it is possible to drive the cooling fan 27 at a rotating rate for an operating time in conformity with an actual amount of heat energy determined based on the residual amount of heat energy.

Thus, if the surface temperature of the original table glass 12 is increased above the regulating value, the cooling fan 27 is driven at the rotating rate in conformity with the actual temperature rise. As a result, it becomes possible to cool down the original table glass 12 pertinently and efficiently whereby the surface temperature of the original table glass 12 can all the time be kept at the regulating value or less. Accordingly, unlike in the conventional configurations, the system of the embodiment is free from problems such as excessive cooling, insufficiency of cooling and the like and no harmful effects occur on the fixing unit and the other components, and consequently, this extends the life of the copier and contributes to improving the reliability of the apparatus.

In practice, the temperature rise inside the machine is mainly determined by such factors as the number of copies, the operating time and the level of exposure. However, with variations of the sheet sizes (both original size and the output sheet size), the scan length and scanning time of the exposure unit 13 (the allowable number of copies per one minute) will change. With this change, temperature-rise distribution of the original table glass 12 may change and the heat energy amount to be generated could also change. That is, the surface temperature of the original table glass 2 and the machine-inside temperature are subject to be affected by the original size and output paper size used. For this reason, the temperature-rise characteristics should be calculated based on the heat energy amount which is estimated based on the factors inclusive of the paper sizes or the turn-on time of the halogen lamp 14, and operating data in conformity with the thus calculated temperature-rise characteristics is to be stored in the microcomputer 33. Hence, when copying operation is effected in this configuration, it is possible to drive the cooling fan 27 at an appropriate rotating rate in conformity with the paper sizes, whereby a further reduction of noises and energy saving can be realized.

Second Embodiment

In a copier of this embodiment, a controller 30 has an operating condition determining means for determining the operating conditions of a cooling fan 27 based on the usage history of the copier. Stored in a microcomputer 33 is operating data on rotating rate and operating time of the cooling fan 27 which has, in advance, been deduced based on the temperature-rise characteristics in association with the usage history of the copier (that is, how frequent the machine has been used and how many copies have been produced for a unit period). In other words,, the system is so set up that the fan may activate at a low rotating rate for a short span when copies are made less frequently per a unit period while the fan may activate at a higher rotating rate for a longer span as the number or frequency of copies becomes great.

The operating condition determining means has three kinds of functions: a memory function for memorizing a usage history of the copier for every predetermined number of copies or for every predetermined unit period of time, such as the copying specifications effected, the number of copies and copying time in a day, the number of copies and copying time in a week and the like; a function of determining the use conditions for a unit period by statistically processing the last copying specifications and operating time and the usage history of the copier; and a function of determining a rotating rate and an operating time of the cooling fan 27 in association with temperature-rise characteristics determined by comparing temperature-rise characteristics estimated from the usage conditions per a predetermined unit period with temperature-rise characteristics stored in advance in the microcomputer 33. The other configurations of this embodiment are the same with those in the first embodiment.

Figure 7:
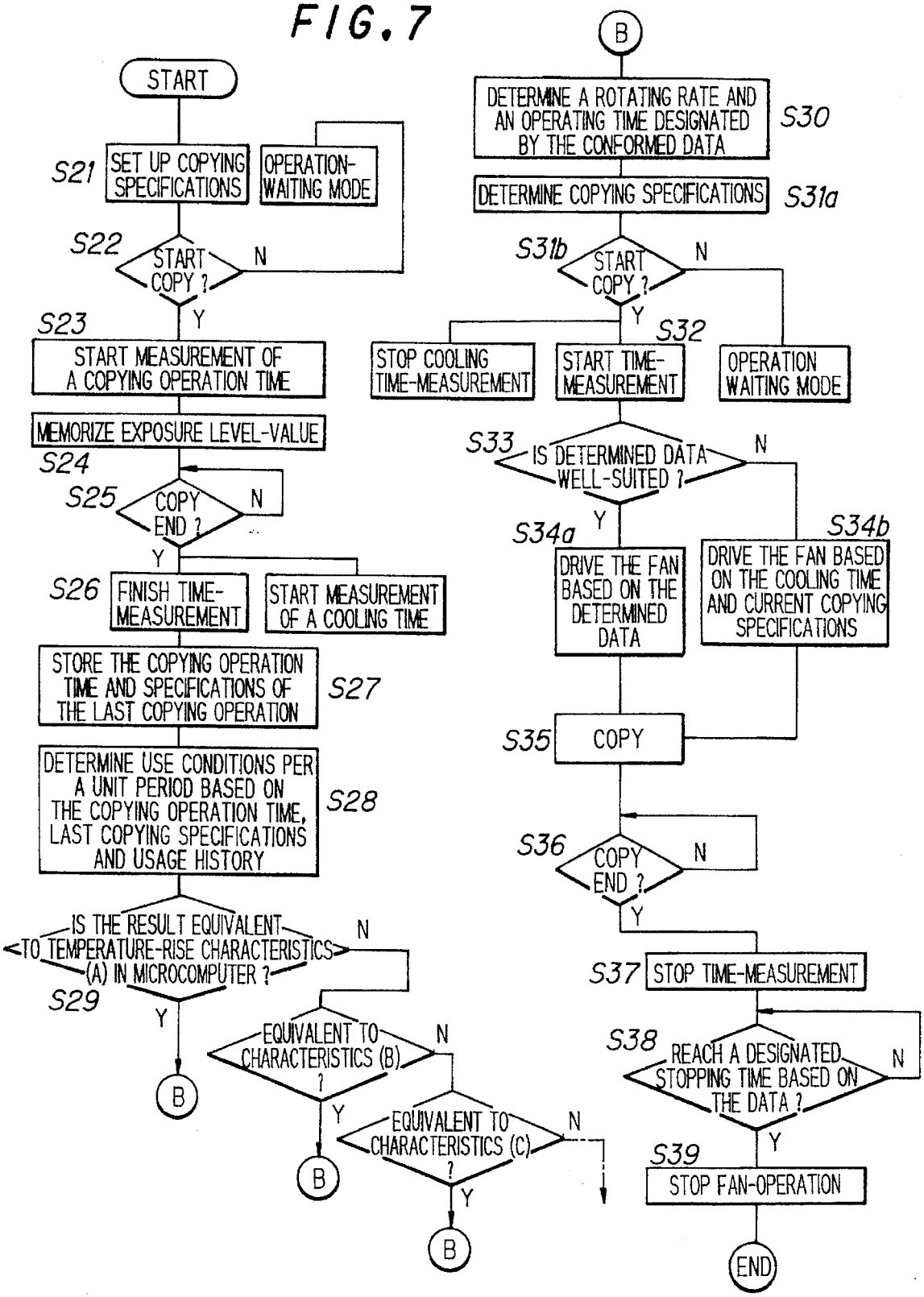
FIG. 7 is a flowchart showing a cooling control system in a second embodiment of the present invention.

In the above configuration, the operation as shown in FIG. 7 is effected. That is, as a user sets up copying specifications (S21) and presses a start button (S22), a timer starts to measure a time of the copying operation until the end of the operation (S23) and then an exposure level-value of the exposure device 13 is stored in the microcomputer 33 (S24). The measurement of copying operation time is to measure turn-on time of the halogen lamp 14. That is, an actual amount of heat energy can be known from the measurement of copying operation time and is used as one of factors for evaluating the usage situation because, in some cases, the actual amount of heat energy may deviate from an estimated amount of heat energy based on the copying specifications if the paper size used changes. The microcomputer 33 monitors the time, the specifications of copying operations while the main switch 30*a* is activated. The thus monitored data as to effected copying jobs, the number of copies and copying time for every day and for every week is stored as a usage history for every predetermined unit of copies or for every predetermined unit of period.

Next, when the copying operation is complete (S25), the measurement of the copying time is also ended (S26) and the last copying specifications and copying time are stored in the microcomputer 33 (S27). Then, the last copying specifications and copying time, together with the past usage history memorized in the microcomputer 33, are statistically processed so that recent usage history per a predetermined unit period of time is determined (S28). Subsequently, a comparison is made of temperature-rise characteristics estimated from the usage history per a predetermined unit period of time with temperature-rise characteristics stored in the microcomputer 33 (S29) and retrieves data (rotating rate and operating time of the fan) is retrieved in accordance with the coinciding temperature-rise characteristics whereby the rotating rate and operating time of the cooling fan 27 at a next copying operation is determined (S30). In this case, the system is so set up that the cooling fan 27 is driven at a high rotating rate for a long period if frequent copying operations have been made recently while the fan 27 is driven at a low rotating rate for a short period if recent copying operations have been made less frequently.

Thereafter, a user sets up a next set of copying specifications (S31*a*) and presses the start button (S31*b*), then the copying specifications are stored in the microcomputer 33. In this while, the controller 30 always measures the cooling time from the end of the pervious copying operation until the start of the current copying operation (S32) other than the copying operation time. At that time, if the time span from the end of the previous copying operation to the start of the current copying operation is too short, the original table glass 12 and the machine-inside may not have been enough cooled in some cases. Therefore, as the copy button is pressed, the microcomputer calculates a heat energy amount to be generated at the current copying operation based on the cooling time and designated current copying specifications and determines whether the cooling fan 27 should be operated in accordance with the determined data (S33). If the cooling time is judged as to be sufficiently long, the cooling fan 27 is driven based on the determined data (S34*a*). If the cooling time is judged as to be insufficient, the temperature-rise characteristics based on the heat energy amount is retrieved from the microcomputer 33 to drive the cooling fan 27 based on the temperature-rise characteristics or to correct the data determined based on the usage situation and drive the cooling fan 27 at a higher rotating rate for a longer operating time than those designated by the determined data (S34*b*), thus stating the copying operation (S35).

When the copying operation is complete (S36), the measurement of the time of copying operation also is ended (S37) while the cooling fan 27 continues to rotate at the same rotating rate as in the copying operation. When it comes to the time designated by the data to stop the fan (or the time the original table glass 12 is cooled down to the regulating temperature or less) (S38), the copier stops the rotation of the fan (S39) and enters the pre-heating or waiting mode for copy-allowable state. Thus, the above-described operations will be repeated.

Thus, in this copier, copying specifications, the number of copies and copying time in a day, or the number of copiers and copying time in a week are memorized for every predetermined number of copies or for every predetermined unit period of time, and based on the thus stored data, operating conditions such as the rotating rate and operating time of the cooling fan 27 are determined. As a result, it is possible to drive the cooling fan 27 at an appropriate rotating rate in conformity with the usage history of the copier. That is, the system is so set up that the fan is driven at a low rotating rate when not so many copying operations are made while the fan is driven at a higher rotating rate with the augment of the copying frequency. Therefore, when the copier is used in a normal way, the cooling fan 27 is driven at a low rotating rate, whereby reduction of noises and energy saving can be realized and it is possible to maintain efficient operations of the copier and comfortable setting environment.

Further, if the usage condition changes in disagreement with the usage history, for example, the cooling time becomes short or the copy volume increases extremely, optimal rotating rate and operating time in conformity with the usage condition are selected. As a result, it is possible to realize efficient operations capable of saving energy and reducing noises.

The present invention should not be limited to the above embodiments but many variations and modifications can be made in the above embodiments within the scope and spirit of the present invention.

Although, after a copying operation is complete, the cooling fan 27 is made to keep on being driven at the same rotating rate as in the copying operation in the above first and second embodiments, the system can be so set up, for instance, that the cooling fan may be driven at a reduced rotating rate after the end of copying operation depending on the surface temperature of the original table glass 12 or the fan may be stopped after the completion of the copying operation especially if the surface temperature is low. Alternatively, it is possible to construct a system that, at the end of copying operation, data in association with the temperature-rise characteristics calculated based on the current or just finished copying specifications are retrieved from the microcomputer 33, and the cooling fan 27 is driven based on the data after the copy end and stopped when it comes to the time that data designates to stop. In this case, since the rotation of the cooling fan 27 is retarded from the state during the copying operation when the copying operation finishes, it is possible to efficiently reduce noises as well as to save energy.

Figure 1:
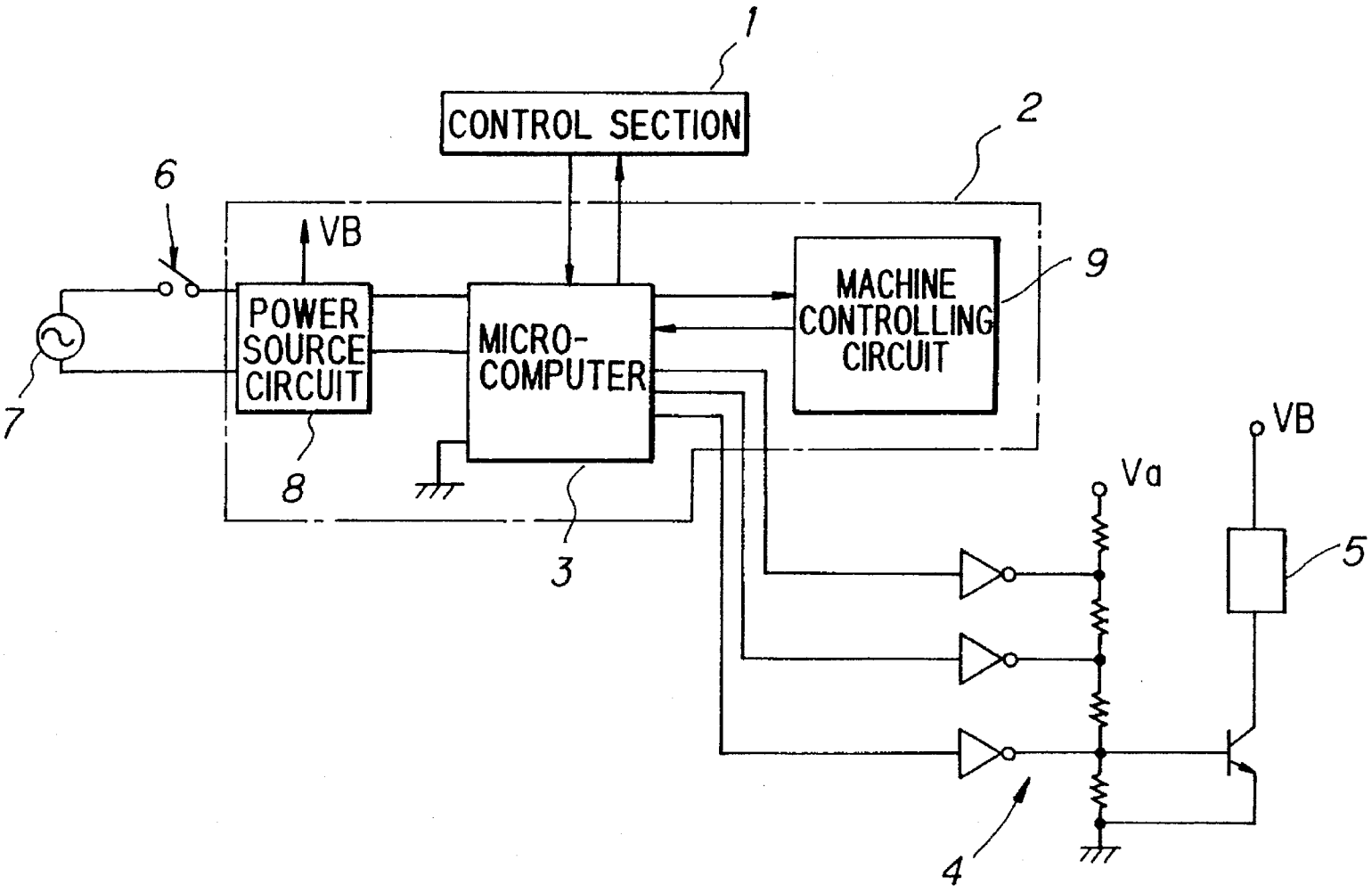
FIG. 1 PRIOR ART
FIG. 1 is a block diagram showing a controller in a conventional image forming apparatus.
Figure 8:
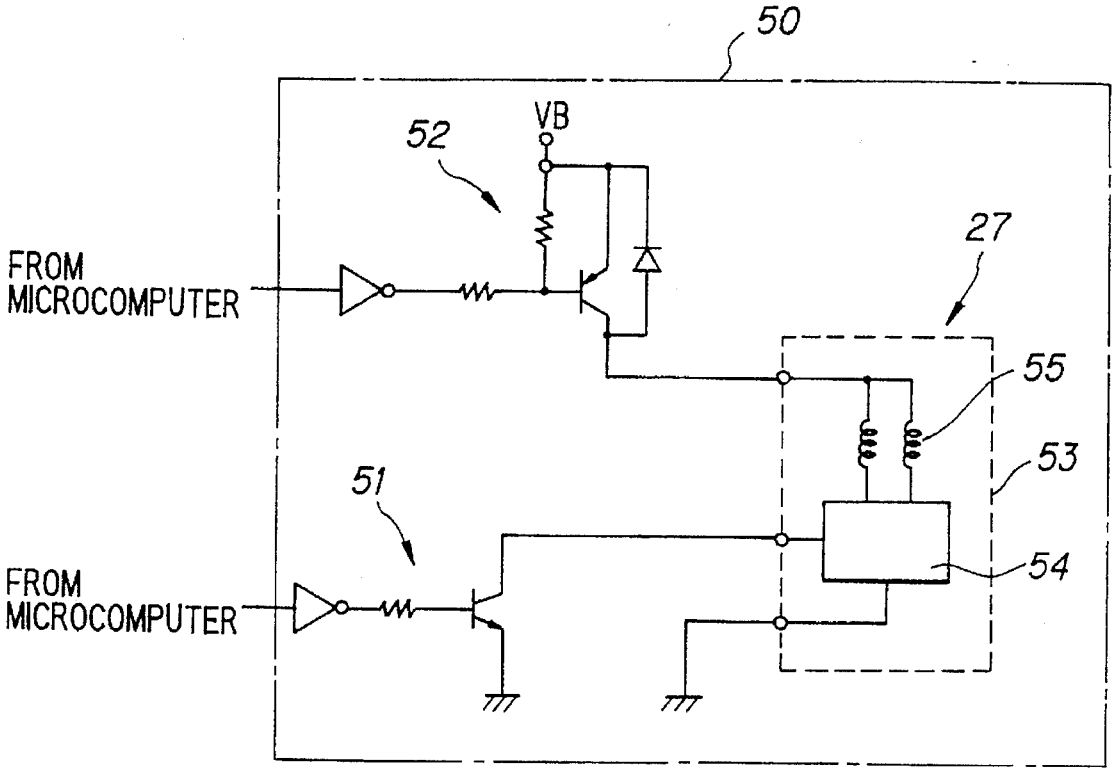
FIG. 8 is a circuit diagram for controlling a brushless motor.
Figure 9:
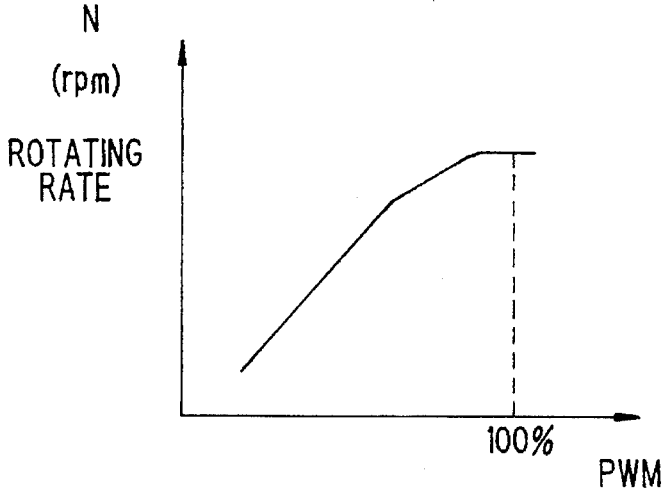
FIG. 9 is a chart showing a relation between PWM characteristics and rotating rates of a fan.
Figure 10:
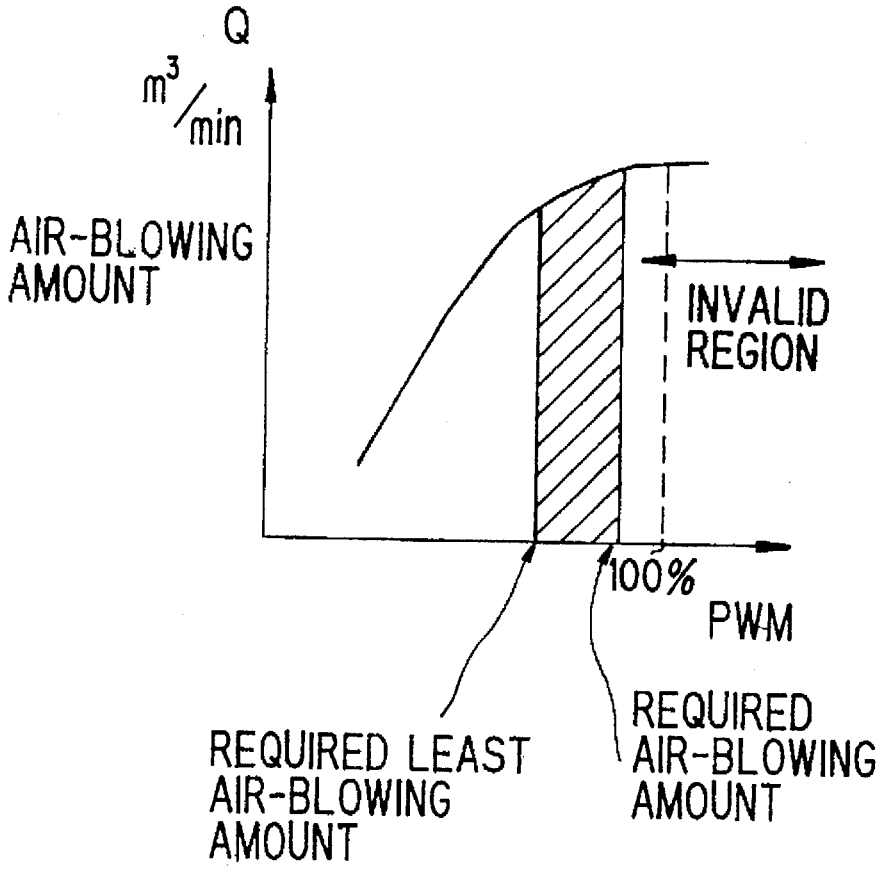
FIG. 10 is a chart showing a relation between PWM characteristics and air-blowing amount of a fan.

Although PWM output from the microcomputer 33 is used in the above first and second embodiments so as to continuously control and vary the rotating rate of the cooling fan 27, it is also possible to use a conventional controlling method as shown in FIG. 1 where the rotation of the fan is controlled step-wise. Although a brush motor 39 is used as a driving motor for the cooling fan 27, a brushless motor may also be used in place. Use of a brushless motor, however, needs a phase-switching IC etc., and the motor requires a driving voltage above a certain level (typically 5 V) and cannot be operated with a very low voltage. Besides the use of brushless motor suffers from another problem that the phase-switching IC cannot be compatible with the above configuration in which pulsing or intermittent voltages are used. To solve this problem, a fan controlling circuit 50 is composed of two separate components as shown in FIG. 8, that is, a governor power source circuit 51 and a motor driver power source circuit 52 so as to allow the use of a brushless motor 53. In FIG. 8, reference numerals 54 and 55 designate a phase-switching IC and coils of motors, respectively. In activating the brushless motor 53, a constant voltage is supplied from the microcomputer 33 to the phase-switching IC 54 through the governor power source circuit 51. This application of the voltage to the phase-switching IC 54 causes a current to flow through the coils 55 of the motor so that the motor is rotated by the electromagnetic induction. When a PWM signal is inputted from the microcomputer 33 to the brushless motor 53 through the motor driver power source circuit 52, the thus generated magnetic force is varied so as to regulate the energy to be inputted to the motor. That is, the rotating rate of the brushless motor 53 varies in accordance with the frequency of the PWM signal. Here, in controlling motors of this kind, the rotating rate of the motor can be regulated stably by using PWM signals having a pulse-duty range of 100% or less, as shown in FIGS. 9 and 10, when the machine (such as a copier) is operated at the maximum energy mode. This is because each kind of machine has a specific range of blowing between a required least air-blowing amount and a required air-blowing amount (shown by hatching in FIG. 10) and the excessive blowing amount of air beyond this range will cause energy loss and noises.

Now, let us compare the characteristics of the brush motor 39 and the brushless motor 53. The brush motor 39 is low in cost and thin in thickness so that if it is used with a cross-flow type fan, the motor can be mounted anywhere and therefore it is possible to improve the space factor. Further, a simple controlling means such as frequency variable control can be used and a greater amount of air-blowing can be obtained as compared to the brushless motor 53 widening the variation of usage. On the other hand, the brushless motor 53 has a longer life than the brush motor 39. General-purpose products can commonly be used, this makes it possible to reduce the cost. Further, electromagnetic wave noises can be reduced. Thus, it is possible to select any one of the brush motor 39 and the brushless motor 53 in accordance with the performances, level and feature of a copier. This freedom of the selection contributes to reduction of the total copier price as well as to energy saving, thus making it possible to widen the application fields.

In the first and second embodiments, the original table glass and therearound are cooled by controlling the operation of the cooling fan 27 while the ventilating fan 28 is rotated at a constant rate. However, it is possible to regulate the temperature rise inside the machine by controlling the operation of the ventilating fan 28 or by controlling both the cooling fan 27 and the ventilating fan 28, simultaneously. This configuration allows the ventilating fan 28 to be driven at an appropriate rotating rate so that the temperature inside the machine may be maintained properly, without affecting the fixing unit 22 as well as the other components. This configuration further allows effective use of the ozone filter 29 and improves the efficiency of the filter. Moreover, the fixing unit 22 can be prevented from being excessively cooled. That is, the air flow toward the fixing unit 22 is weakened so that temperature drop of the heater can be prevented. Therefore it is possible to realize energy saving and therefore improve total efficiency of the copier.

Further, the second embodiment is constructed such that the system determines the operating condition of the cooling fan 27 based on the usage history and judges whether the determined operating condition is proper or not at the start of the copying operation, but it is possible to drive the cooling fan 27 by just the determined operating condition without any judgment.

Although the above embodiments are described about the copiers, the present invention can also be applied to image forming apparatuses such as printers having an exposure device.

As has been apparent from the above description, according to the present invention, the operating condition of the fan is determined based on the past and current copying specifications and cooling time or usage history of the copier, it is possible to totally control the operation of the fan in conformity with the actual temperature rise and therefore it is possible to cool the machine-inside properly and efficiently.

Further, even if a second copying operation is started before the temperature rise inside the machine due to a first copying operation is dissipated enough, the system determines the residual amount of heat energy so as to be able to drive the fan at a rotating rate for an operating time in association with the actual amount of heat energy. As a result, it is possible to cool the machine-inside properly and efficiently, thus making it possible to always regulate the temperature inside the machine lower than the regulating value. By this effect, no problem such as excessive cooling or insufficient cooling which would occur in the conventional configuration does not occur, and therefore no adverse effect can be imparted to the other components inside the apparatus. Consequently, it is possible to lengthen the life of the image forming apparatus and improve the reliability of the apparatus.

Since the rotating rate of the fan is so set up that it works at a low rate when a less number of image forming operations are effected while it works at a higher rotating rate with the augment of the frequency of image forming operations, the fan is set to work at a low rotating rate when the apparatus is operated in a usual mode. Accordingly, it is possible for the present invention to reduce noises as well as save the energy. Also it is possible to contribute to effecting efficient operations of the image forming apparatus and to maintain comfortable setting environment of the apparatus.

What is claimed is:

1. An image forming apparatus including a machine body comprising:

a cooling fan for inhibiting the temperature rise inside the machine body; and a controller for controlling the operation of said fan, said controller including an operating condition determining means for determining operating conditions of said fan based on an amount of heat energy generated in a previous image forming operation, a dropped amount of heat energy from the end of the previous image forming operation to the start of a current image forming operation and an amount of heat energy generated in the current image forming operation.

2. An image forming apparatus according to claim 1 wherein said operating condition determining means measures a cooling time from the end of a previous image forming operation to the start of a current image forming operation, estimates a residual amount of heat energy at the start of the current image forming operation based on an amount of heat energy generated in the previous image forming operation and the measured cooling time, adds up an amount of heat energy generated in the current image forming operation and the residual amount of heat energy and determines a rotating rate and an operating time of said fan in accordance with temperature-rise characteristics inside the machine body which is calculated based on the sum of heat energy.

3. An image forming apparatus including a machine body comprising:

a cooling fan for inhibiting a temperature rise inside the machine body; and a controller for controlling the operation of said fan, said controller including an operating condition determining means for determining operating conditions of said cooling fan based on usage history of the apparatus, per a unit period of time.

4. The image forming apparatus including a machine body as claimed in claim 3, wherein the usage history includes how frequently the apparatus has been used and how many copies have been made in said per unit period of time.

5. An image forming apparatus including a machine body comprising:

a cooling fan for inhibiting the temperature rise inside the machine body; and a controller for controlling operation of said fan said controller including an operating condition determining means for determining specifications of a continuous current image forming operation and specifications of a continuous previous image operation.

6. The image forming operation according to claim 5 including instructing means for providing instructions for said current image forming operation and said operating condition determining means determines the specifications of the continuous current image forming operation in response to said instructions.

7. The image forming apparatus according to claim 5, wherein the controller for controlling operation of the fan includes as data for the controlling operation a cooling time period of the fan which is a time period between the continuous previous image operation and the continuous current image operation.

8. The image forming apparatus according to claim 6, wherein the controller for controlling operation of the fan includes as data for the controlling operation a cooling time period of the fan which is a time period between the continuous previous image operation and the continuous current image operation.

* * * * *